US011214344B1

(12) United States Patent
Scherer, III

(10) Patent No.: US 11,214,344 B1
(45) Date of Patent: Jan. 4, 2022

(54) MARINE PROPULSION DEVICE AND LOWER UNIT THEREFOR

(71) Applicant: Brunswick Corporation, Mettawa, IL (US)

(72) Inventor: John O. Scherer, III, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 52 days.

(21) Appl. No.: 16/707,039

(22) Filed: Dec. 9, 2019

(51) Int. Cl.
*B63H 20/34* (2006.01)
*B63H 5/125* (2006.01)

(52) U.S. Cl.
CPC ..... *B63H 5/1252* (2013.01); *B63H 20/34* (2013.01); *B63H 2005/1256* (2013.01)

(58) Field of Classification Search
CPC .. B63H 2020/323; B63H 20/34; B63H 25/42; B63H 25/46; B63H 5/1252; B63H 2005/1256; B63H 21/265
See application file for complete search history.

(56) References Cited

U.S. PATENT DOCUMENTS

| | | | | |
|---|---|---|---|---|
| 2,847,967 | A | 8/1958 | Kiekhaefer | |
| 3,799,103 | A | 3/1974 | Granholm | |
| 4,122,792 | A | 10/1978 | Rhoades et al. | |
| 4,304,557 | A | 12/1981 | Henrich | |
| 4,352,666 | A | 10/1982 | McGowan | |
| 4,529,387 | A | 7/1985 | Brandt | |
| 4,810,218 | A | 3/1989 | Iwai | |
| 5,085,603 | A | 2/1992 | Haluzak | |
| 5,344,349 | A | 9/1994 | Meisenburg et al. | |
| 5,772,481 | A | 6/1998 | Alexander, Jr. et al. | |
| 5,902,157 | A * | 5/1999 | Boris | B63H 20/34 440/51 |
| 5,928,042 | A * | 7/1999 | Quiggins | B63H 20/34 440/72 |
| 6,155,894 | A * | 12/2000 | Allison | B63H 5/16 114/140 |
| 6,558,213 | B1 | 5/2003 | McGowan | |
| 7,335,074 | B2 * | 2/2008 | Arneson | B63H 1/14 440/66 |

(Continued)

FOREIGN PATENT DOCUMENTS

| | | | |
|---|---|---|---|
| CA | 1224382 | A | 7/1987 |
| DE | 202005001130 | U1 | 3/2005 |

(Continued)

OTHER PUBLICATIONS

Poirier et al., "Marine Propulsion Device and Lower Unit Therefor," Unpublished U.S. Appl. No. 16/720,675, filed Dec. 19, 2019.

(Continued)

*Primary Examiner* — Andrew Polay
(74) *Attorney, Agent, or Firm* — Andrus Intellectual Property Law, LLP

(57) ABSTRACT

A marine propulsion device includes an engine, a driveshaft powered by the engine, a propulsor shaft coupled in torque-transmitting relationship with the driveshaft, and a propulsor coupled to the propulsor shaft and rotatable to produce a thrust. A housing supports the propulsor shaft therein. The housing has fore and aft skegs projecting from a bottom surface thereof.

20 Claims, 8 Drawing Sheets

(56) References Cited

U.S. PATENT DOCUMENTS

| | | | | |
|---|---|---|---|---|
| 7,393,256 | B2 | 7/2008 | Clutton et al. | |
| 8,545,280 | B1 | 10/2013 | Patil et al. | |
| 8,821,205 | B2 | 9/2014 | Mead | |
| 9,038,555 | B2 * | 5/2015 | Templeman | B63H 20/34 114/140 |
| 9,359,059 | B1 | 6/2016 | Scherer et al. | |
| 9,738,362 | B2 | 8/2017 | Ketterman et al. | |
| 9,821,897 | B1 * | 11/2017 | Veselsky | B63H 20/12 |
| 2006/0216007 | A1 | 9/2006 | Moreb | |
| 2008/0207070 | A1 | 8/2008 | Van Gelder | |
| 2010/0000461 | A1 | 1/2010 | Wait et al. | |
| 2018/0265174 | A1 | 9/2018 | Miller | |

FOREIGN PATENT DOCUMENTS

| | | | |
|---|---|---|---|
| EP | 431678 | A1 | 6/1991 |
| JP | H05345593 | A | 12/1993 |
| JP | 2904789 | B2 | 6/1999 |

OTHER PUBLICATIONS

Alby et al., Outboard Motors Having Steerable Lower Gearcase, Unpublished U.S. Appl. No. 16/171,490, filed Oct. 26, 2018.

* cited by examiner

MARINE PROPULSION DEVICE AND LOWER UNIT THEREFOR

FIELD

The present disclosure relates to marine propulsion devices for propelling watercraft through water, and more specifically to lower units for marine propulsion devices.

BACKGROUND

The following U.S. Patents and Patent Applications are incorporated herein by reference, in their entireties:

U.S. Pat. No. 5,085,603 discloses a marine drive having a trim tab with a flair on one side thereof at an upper portion. When the drive is trimmed in, the flair is unshrouded by the anti-ventilation plate and diverts mainstream water flow therearound, which produces a force on the other side of the trim tab opposite the flair which counteracts steering torque. In another embodiment, a variable compensation flair is provided.

U.S. Pat. No. 8,545,280 discloses a marine drive having a lower drive unit including a gearcase with a vertical strut having a lower horizontal torpedo with an aft propeller. An anti-ventilation plate on the strut is spaced above the torpedo. A spray shield plate on the strut is spaced above the torpedo and below the anti-ventilation plate.

U.S. Pat. No. 9,359,059 discloses an outboard marine engine comprising an anti-ventilation plate; a torpedo housing that is disposed below the anti-ventilation plate; and a gearcase strut that extends from the anti-ventilation plate to the torpedo housing. The gearcase strut has a leading end, a trailing end, and opposing outer surfaces that extend from the leading end to the trailing end. A flow separator is on each outer surface. The flow separator is located closer to the trailing end than the leading end and causes flow of water across the gearcase strut to separate from the outer surface.

U.S. application Ser. No. 16/171,490, filed Oct. 26, 2018, discloses an outboard motor having a powerhead that causes rotation of a driveshaft, a steering housing located below the powerhead, wherein the driveshaft extends from the powerhead into the steering housing; and a lower gearcase located below the steering housing and supporting a propeller shaft that is coupled to the driveshaft so that rotation of the driveshaft causes rotation of the propeller shaft. The lower gearcase is steerable about a steering axis with respect to the steering housing and powerhead.

SUMMARY

In one embodiment, a lower unit for a marine propulsion device comprises a gearcase housing defined in a longitudinal direction between a fore end and an aft end, a propulsor shaft extending through the gearcase housing in the longitudinal direction, and a driveshaft extending non-parallel to the propulsor shaft, the driveshaft being coupled in torque-transmitting relationship with the propulsor shaft. A fore skeg projects from a bottom surface of the gearcase housing proximate the fore end thereof. An aft skeg projects from the bottom surface of the gearcase housing proximate the aft end thereof.

In another embodiment, a marine propulsion device comprises an engine, a driveshaft powered by the engine, a propulsor shaft coupled in torque-transmitting relationship with the driveshaft, and a propulsor coupled to the propulsor shaft and rotatable to produce a thrust. A housing supports the propulsor shaft therein. The housing has fore and aft skegs projecting from a bottom surface thereof.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1:
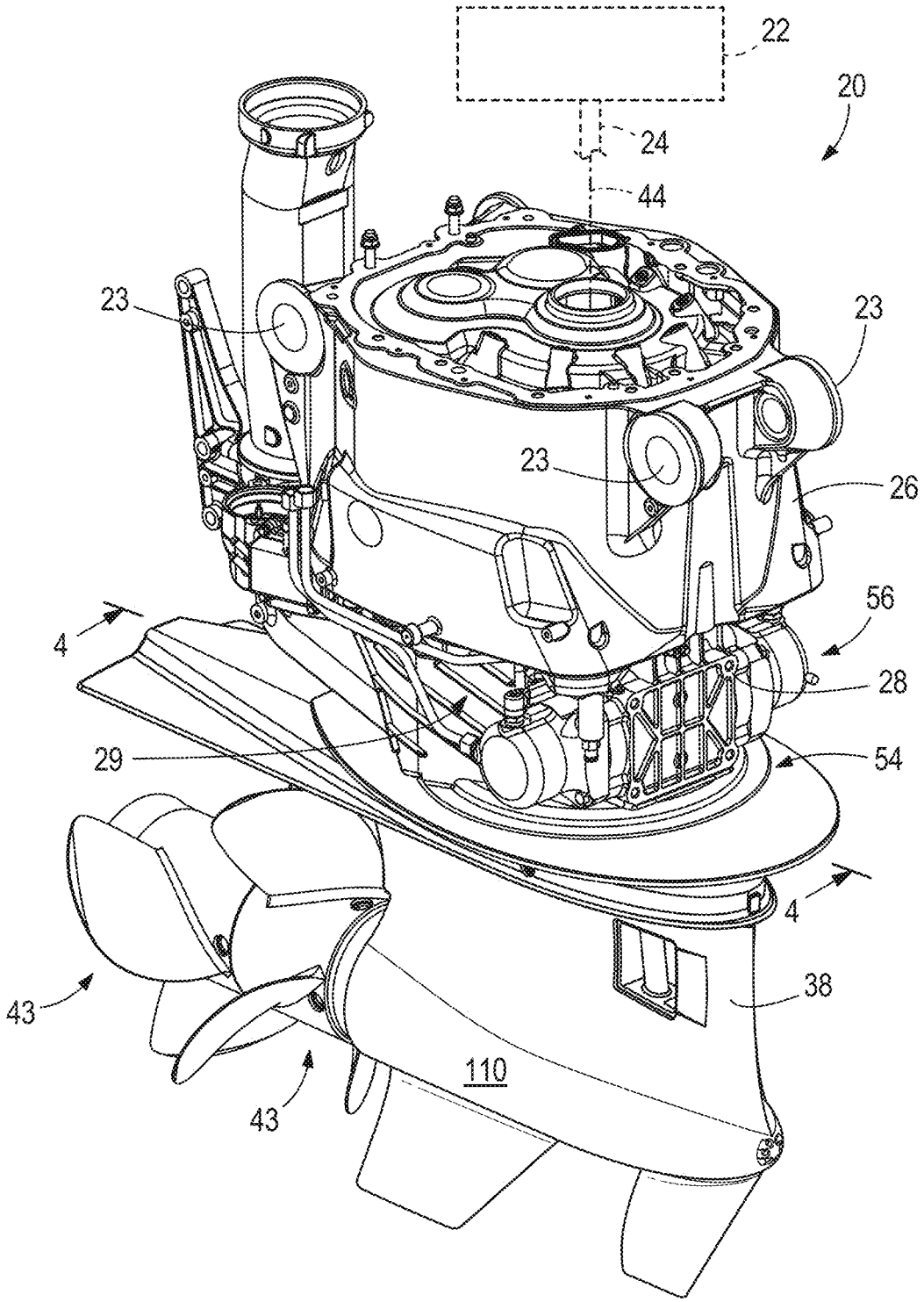
FIG. 1 is a perspective view of a driveshaft housing, steering housing, and lower unit of a marine propulsion device according to an embodiment of the present disclosure.

FIG. 1 depicts a first embodiment of a marine propulsion device (here, an outboard motor) 20 powered by an internal combustion engine (shown schematically at 22 in FIG. 1), for causing rotation of an axially extending driveshaft 24. The driveshaft 24 extends into a driveshaft housing 26 located below the engine 22. Optionally, the driveshaft housing 26 contains a sump for containing oil or similar lubricant for the engine 22. Optionally, the driveshaft 24 is connected to a transmission for engaging forward, reverse, and neutral gear positions of the marine propulsion device 20. Optionally, the driveshaft housing 26 also includes mounting locations 23 for mounting the marine propulsion device 20 to a supporting cradle that is coupled to a transom bracket and/or the like, for supporting the marine propulsion device 20 with respect to the transom of a marine vessel. The type and configuration of the driveshaft housing 26 is merely exemplary and can vary from what is shown.

Figure 2:
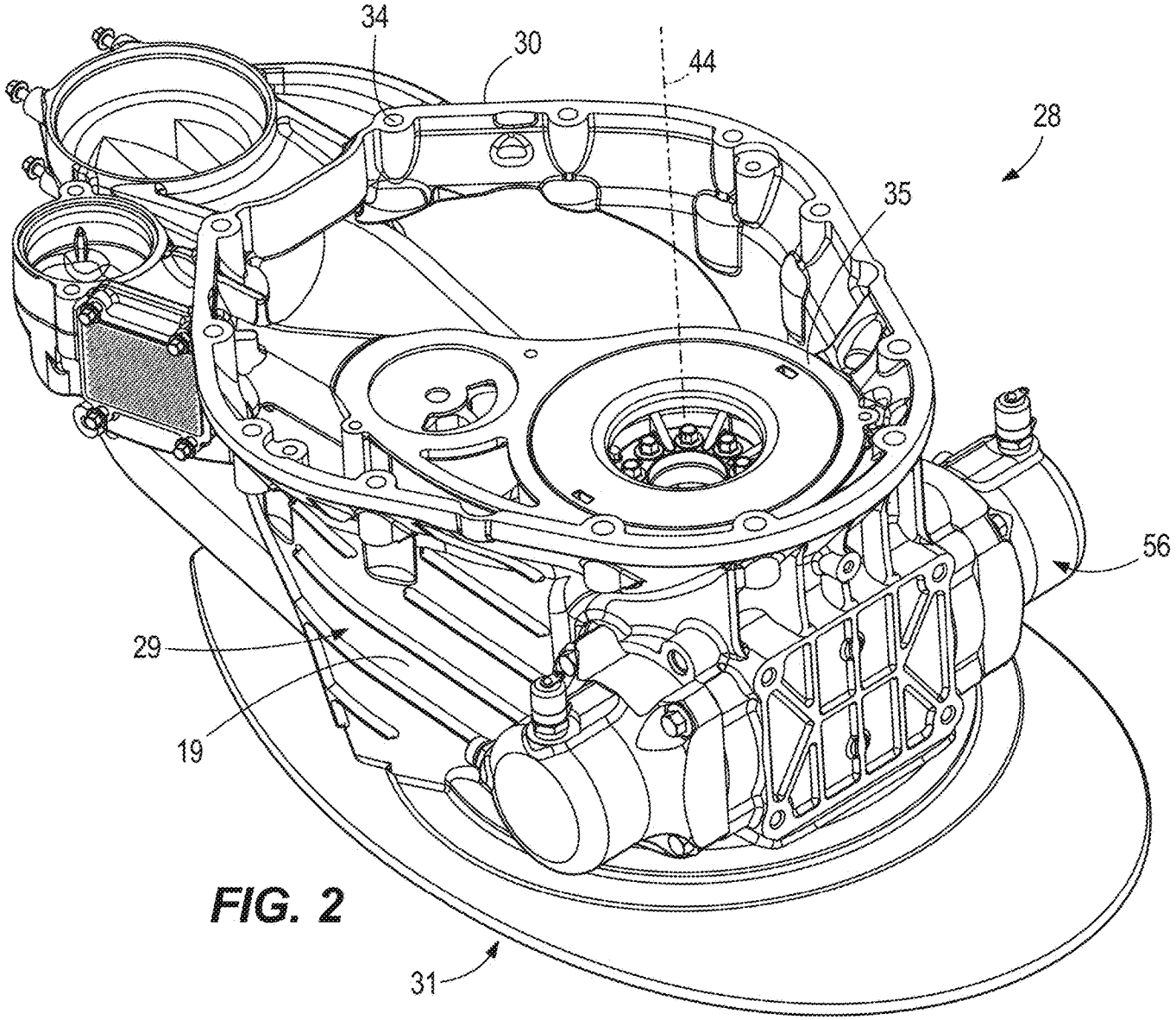
FIG. 2 is a perspective view looking down at a steering housing of the marine propulsion device.

Referring to FIGS. 1 and 2, a steering housing 28 is located below the driveshaft housing 26. The steering housing 28 is a generally oblong member having a main body 29 and upper and lower perimeter mounting flanges 30, 31. The upper perimeter mounting flange 30 is fixed to the lower perimeter of the driveshaft housing 26 by bolts (not shown) engaged in bolt holes 34. The bolts and bolt holes 34 are spaced apart around the upper perimeter mounting flange 30, as shown, so that the steering housing 28 and driveshaft housing 26 remain securely fixed together. A center column 35 defining a through-bore 36 (see FIG. 3) axially extends from top to bottom through the steering housing 28. The driveshaft 24, itself or via an extension member, axially extends through the through-bore 36. In the illustrated example, the center column 35 and through-bore 36 are generally cylindrical and contain a bearing arrangement for supporting steering of the marine propulsion device 20, as will be further described herein below.

Figure 4:
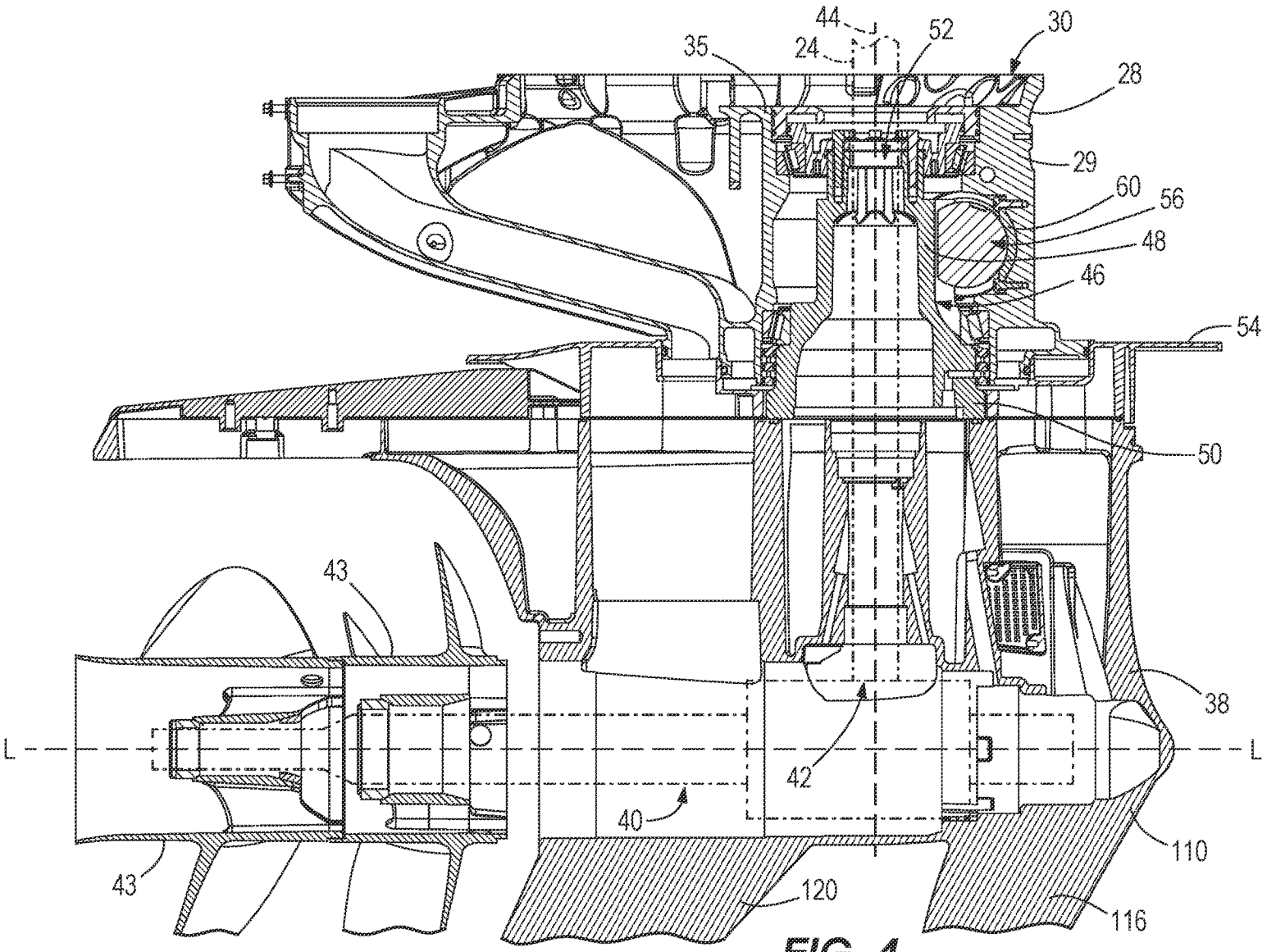
FIG. 4 is a view of section 4-4, taken in FIG. 1, showing the lower unit and steering housing of the marine propulsion device.

Referring to FIGS. 1 and 4, the marine propulsion device 20 also has a lower unit 38, which is located below the steering housing 28 and includes a gearcase housing 110 that supports a propulsor shaft extending through the gearcase housing 110 in a longitudinal direction L. In this example, the gearcase housing 110 supports two longitudinally extending propeller shafts, the location of which is shown via dashed lines 40 in FIG. 4. Although the illustrated example utilizes a pair of counter-rotating propeller shafts 40, an arrangement with only one propeller shaft could instead be employed. The driveshaft 24 or an extension thereof extends into the gearcase housing 110 non-parallel (here, perpendicular or near perpendicular) to the propulsor shaft (e.g., propeller shafts 40). The driveshaft 24 is coupled in torque-transmitting relationship with the propulsor shaft, for example directly thereto or via an axial extension thereof (which is therefore also a driveshaft), by a conventional angled gearset, the location of which is shown by dashed lines 42. The angled gearset 42 is configured in the usual way so that rotation of the driveshaft 24 about its own axis causes counter-rotation of the propeller shafts 40 about their own longitudinally extending axes. Counter-rotating propellers 43 are mounted on the pair of propeller shafts 40, respectively, so that rotation of the propeller shafts 40 causes rotation of the propellers 43. Rotation of the propellers 43 generates thrust forces in water, all as conventional.

Figure 3:
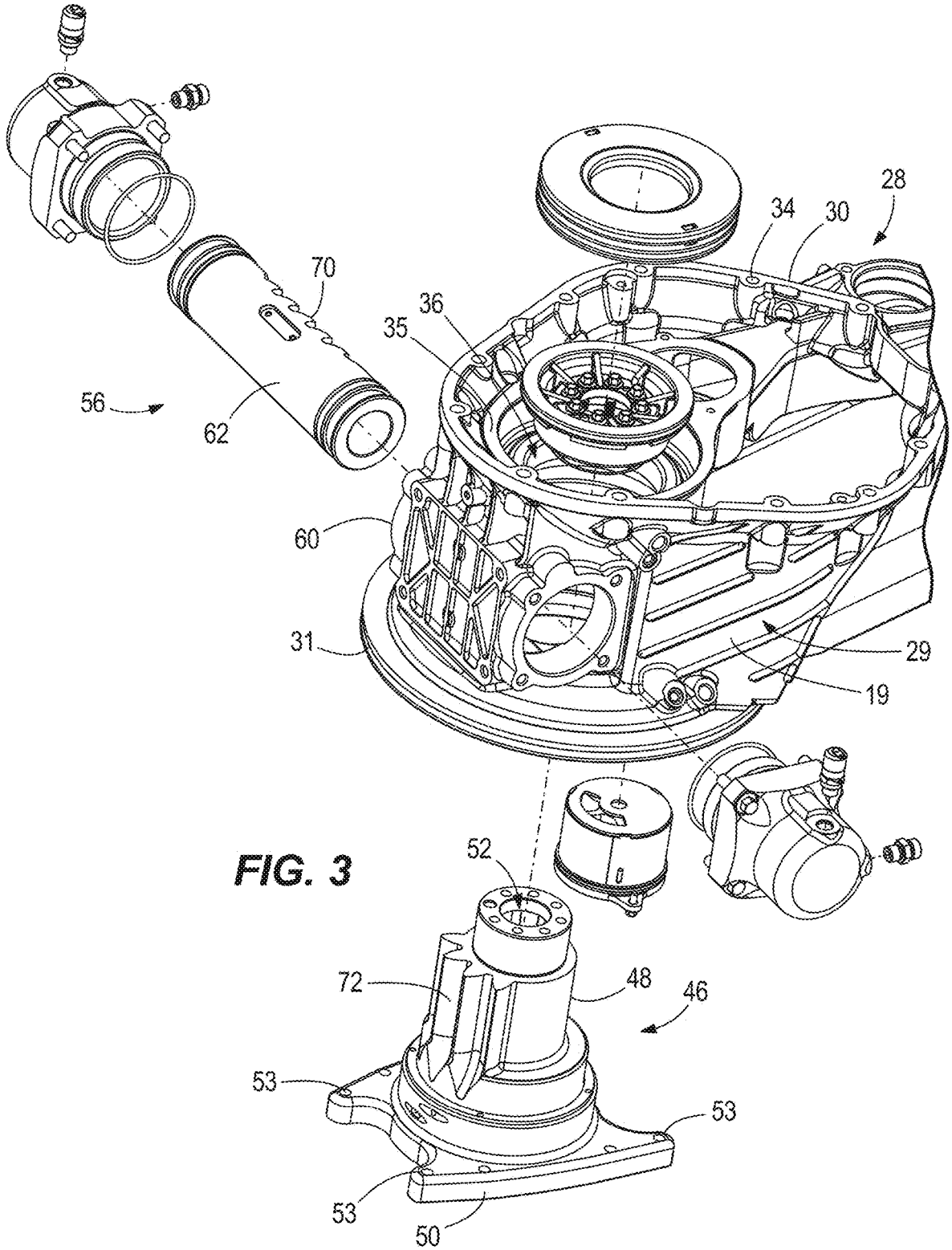
FIG. 3 is an exploded view showing the steering housing, steering actuator, and a steering column of the marine propulsion device.

Referring to FIGS. 1 and 3, the lower unit 38 is steerable about a steering axis 44 with respect to the steering housing 28 and engine 22, and thus is steerable to change a direction of thrust produced by the marine propulsion device 20. In the illustrated example, the steering axis 44 is coaxial with the driveshaft 24. A steering column 46 (FIG. 3) is fixed to the top of the lower unit 38 and extends upwardly into the bottom of the steering housing 28. The steering column 46 is an elongated member having a center column 48 that extends upwardly from a lower perimeter mounting flange 50. A through-bore 52 extends through the center column 48 and defines an open interior in the center column 48. The driveshaft 24 (or the extension thereof) extends through the open interior of the center column 48, into the lower unit 38, and into engagement with the noted propeller shafts 40 via the noted angled gearset 42.

Referring to FIGS. 1 and 4, a cover 54 is fixed to the top of the lower unit 38. Optionally, the cover 54 is a plate member that is separate component from the lower unit 38. The lower perimeter mounting flange 50 of the steering column 46 is coupled to the cover 54 via bolts (not shown). The bolts extend through bolt-holes 53 (FIG. 3) formed through the lower perimeter mounting flange 50 on the steering column 46 and through the cover 54, respectively, and fix the cover 54 with respect to the lower unit 38 so that the lower unit 38, cover 54 and steering column 46 rotate together with respect to the steering housing 28. The manner in which the steering column 46 is fixed to the top of the lower unit 38 can vary from what is shown and described.

Referring to FIG. 3, a steering actuator 56 is configured to rotate the steering column 46 together with lower unit 38 with respect to the steering housing 28 and engine 22. The type and configuration of the steering actuator 56 can vary. In the example shown in FIG. 3, the steering actuator 56 is a hydraulically-actuated mechanism controlled by a supply of hydraulic fluid from a conventional hydraulic pump (not shown). The steering actuator 56 has an elongated cylinder 60 to which the pump provides a pressurized supply of hydraulic fluid. In this example, the elongated cylinder 60 is formed in the main body 29 of the steering housing 28 and particularly through opposing sidewalls 19 on opposite sides of the steering housing 28, as shown. The steering actuator 56 further has an elongated piston 62 that is located in the cylinder 60. The piston 62 is movable (i.e., slide-able) back and forth in the cylinder 60 under pressure from the hydraulic fluid provided by the pump.

The steering actuator 56 is operably coupled to the steering column 46 by a rack and pinion, which in this example includes sets of teeth 70, 72 on the piston 62 and the center column 48 of the steering actuator 56, respectively. The sets of teeth 70, 72 are meshed together so that back-and-forth movement of the piston 62 within the cylinder 60 causes the teeth 70 on the piston 62 to move teeth 72 on the center column 48, which in turn causes corresponding back-and-forth rotational movement of the center column 48 about the steering axis 44. Thus, operation of the steering actuator 56 causes the rack and pinion to rotate the steering column 46 together with the lower unit 38 about the steering axis 44 with respect to the steering housing 28 and engine 22. The supply of pressurized hydraulic fluid from the pump to the cylinder 60 can be controlled by a conventional valve arrangement and a conventional operator input device for controlling steering movement of the marine propulsion device 20, such as a steering wheel, joystick, automated positioning system, and/or the like, all as is conventional.

In another example, the steering actuator 56 is mounted to an outer surface of the main body 29 of the steering housing 28 by bolts, rather than being formed with the main body 29. Further, the steering actuator 56 is coupled to the steering column 46 by a yoke and trunnion instead of the rack and pinion. Further details of this embodiment are disclosed in Applicant's co-pending U.S. application Ser. No. 16/171,490, filed Oct. 26, 2018, which was incorporated by reference herein above.

During research and development, the present inventor realized that the spinning driveshaft 24 places a large torque load on the steerable lower unit 38, which torque load is required to be counteracted by the steering actuator 56 in order to hold the lower unit 38 (and thus the thrust-producing propellers 43) in a desired position to steer a marine vessel. In other words, the hydraulic pump must provide enough pressurized hydraulic fluid to the cylinder 60 to maintain the piston 62 in a desired position against the torque load from the driveshaft 24 that tends to rotate the lower unit 38 (and thus the steering column 46 and the piston 62 connected thereto) away from this position. The present inventor realized that producing a moment on the lower unit 38 in a direction opposite the driveshaft's rotational direction could reduce the resultant load on the steering system, which would increase the life of the system and/or allow for less robust (and therefore less expensive and/or lighter) parts to be used. The present inventor determined that by adding an additional skeg to the bottom of the gearcase housing 110, and by designing one or both skegs to produce a moment on the lower unit 38 as the lower unit 38 moves through water, the torque induced by the driveshaft 24 could be countered, and overall load on the steering system reduced.

Figure 5:
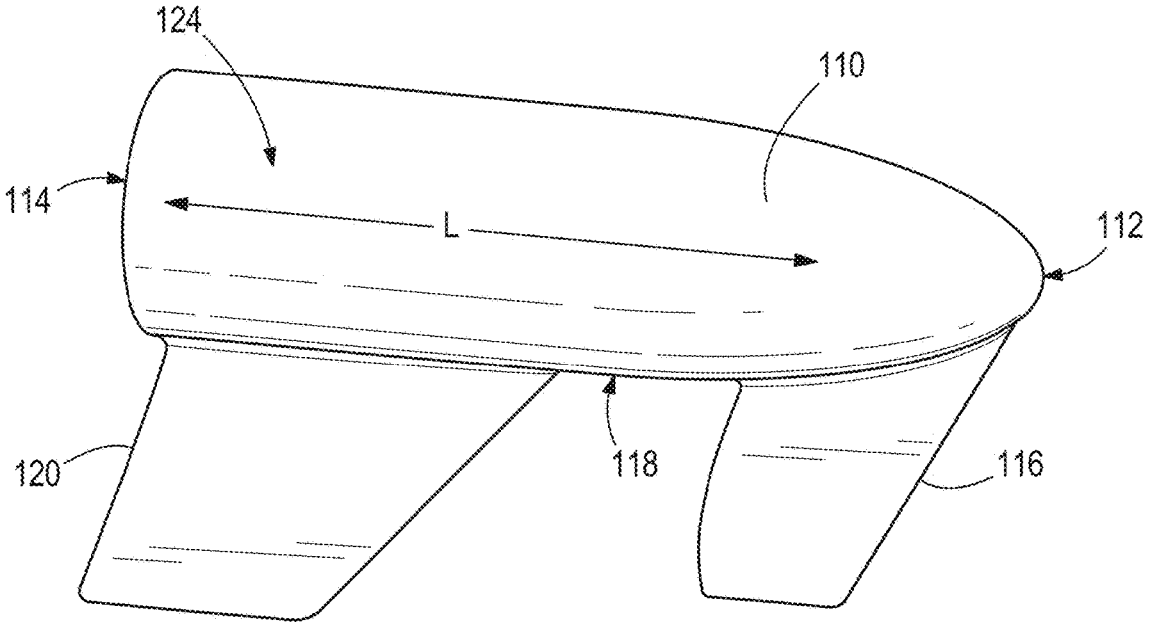
FIG. 5 illustrates a starboard-side perspective view of a gearcase housing of the marine propulsion device.
Figure 6:
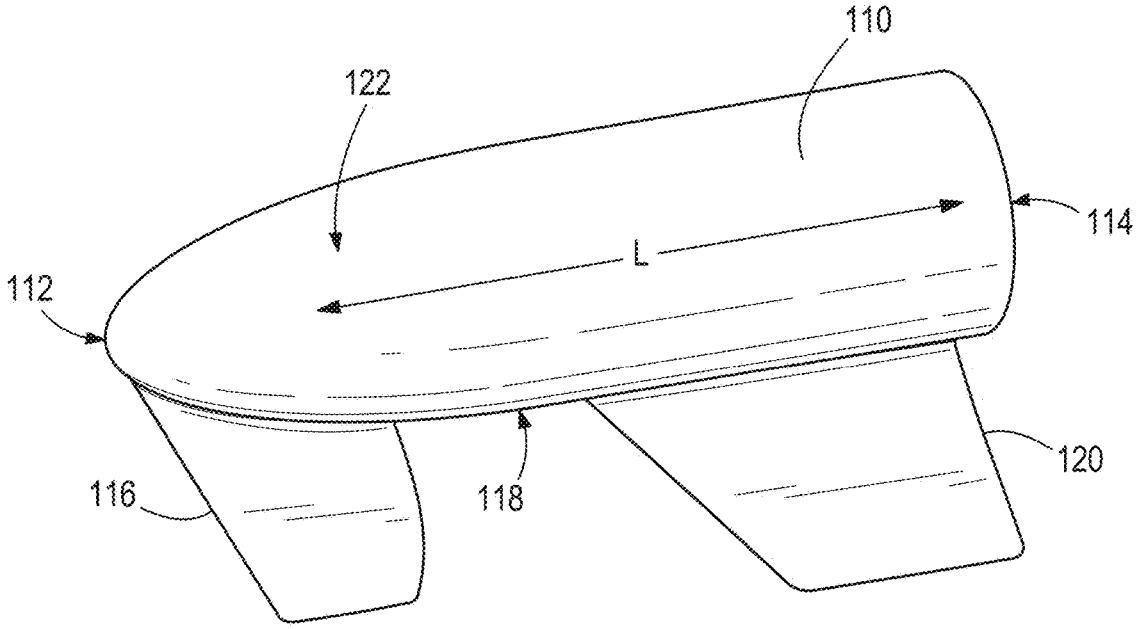
FIG. 6 illustrates a port-side perspective view of the gearcase housing.

Turning to FIGS. 5 and 6, the gearcase housing 110 of the lower unit 38 of the present disclosure is shown in isolation. The gearcase housing 110 is defined in a longitudinal direction L between a fore end 112 (nose) and an aft end 114

Figure 7:
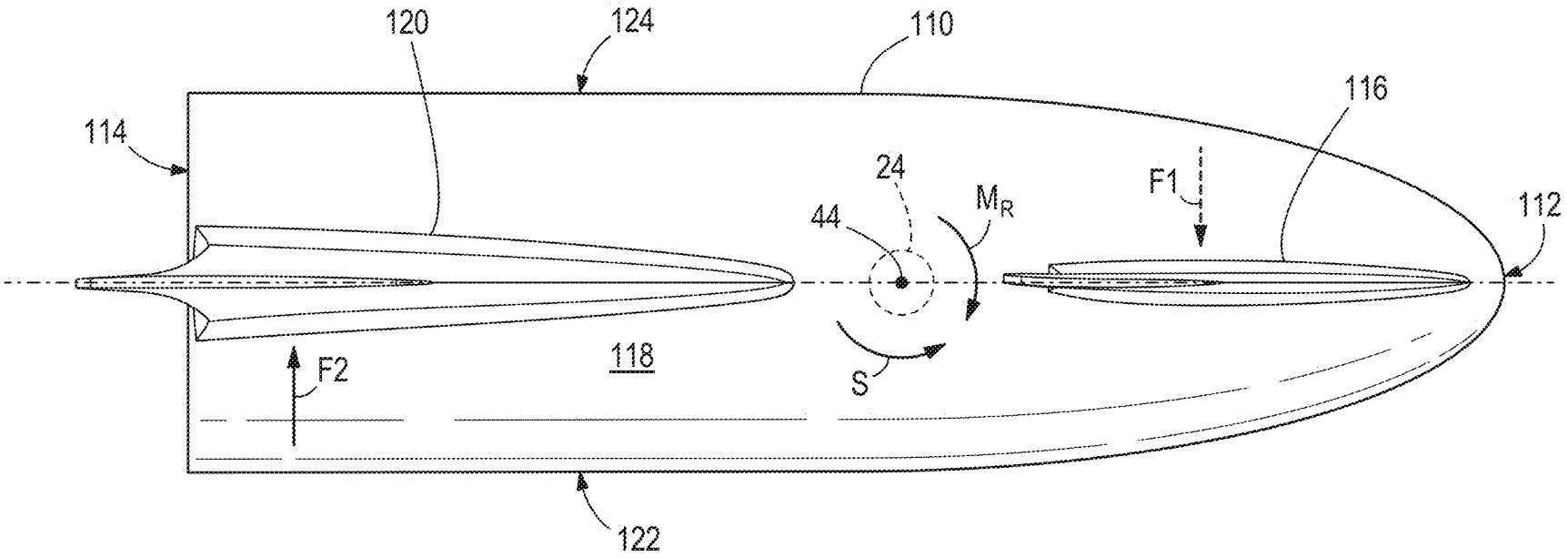
FIG. 7 illustrates a bottom view of the gearcase housing.

(where the propellers 43 would be located). A fore skeg 116 projects from a bottom surface 118 of the gearcase housing 110 proximate the fore end 112 thereof. An aft skeg 120 projects from the bottom surface 118 of the gearcase housing 110 proximate the aft end 114 thereof. The fore and aft skegs 116, 120 are spaced from one another in the longitudinal direction L. In the present example, as shown in FIG. 7, the fore skeg 116 is located forward of the driveshaft 24, and the aft skeg 120 is located behind the driveshaft 24. The fore and aft skegs 116, 120 are designed to produce opposite laterally-directed forces on the gearcase housing 110 that counteract the torque induced by the spinning driveshaft 24, as will be described further herein below.

Figure 9:
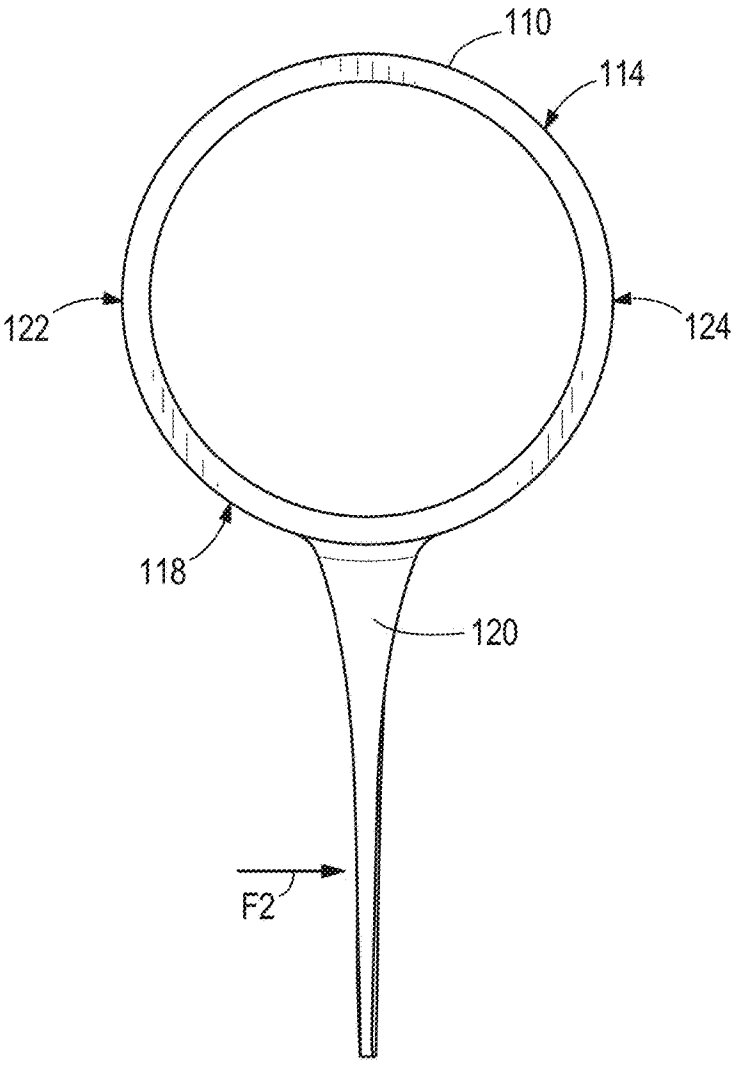
FIG. 9 illustrates a back view of the gearcase housing.
Figure 8:
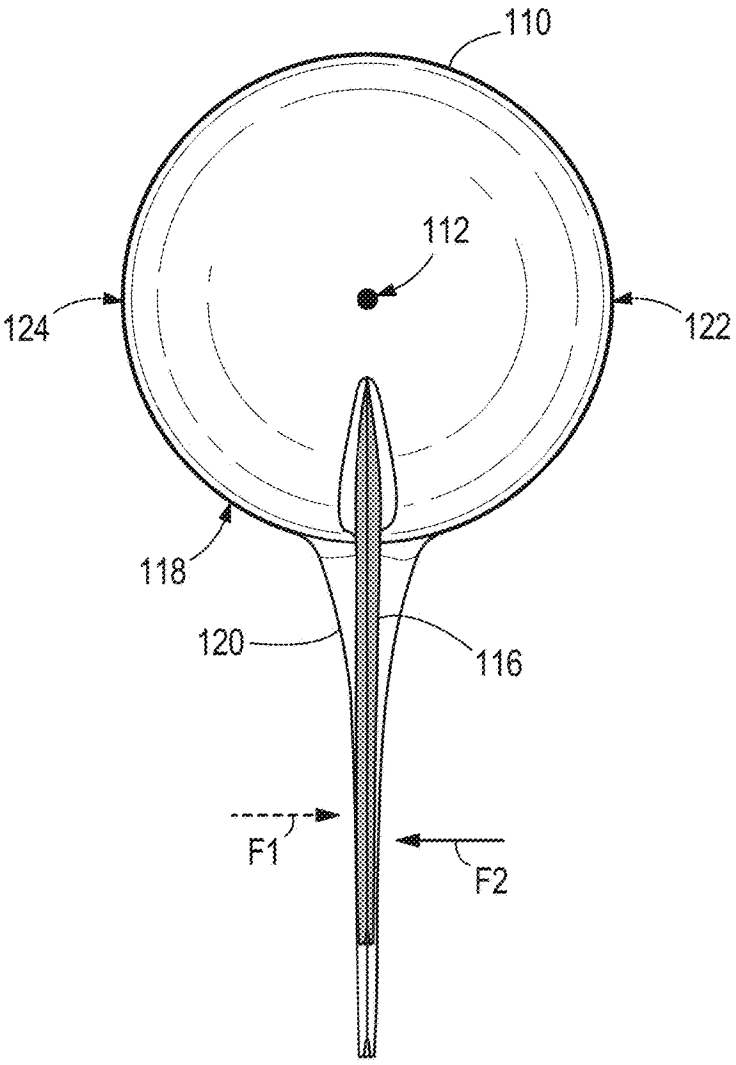
FIG. 8 illustrates a front view of the gearcase housing.

Turning to FIGS. 7-9, the fore skeg 116 is configured to produce a first laterally directed force F1 on the gearcase housing 110 (and thus the lower unit 38) as the lower unit 38 moves through water. At the same time, the aft skeg 120 is configured to produce a second laterally directed force F2 on the lower unit 38 as the lower unit 38 moves through water. As shown, the first and second forces F1, F2 are opposite one another. (In FIG. 8, the fore skeg 116 is shown with shading so it can be distinguished from the aft skeg 120 directly behind it.) The forces F1 and F2 are shown as having roughly the same magnitude, but this is not necessary, and the forces are not drawn to scale. Note that the location of the forces is also not shown to scale, but rather is schematic and for explanatory purposes only. Additionally, note that the forces F1 and F2 may not be perfectly perpendicular to a plane bisecting the gearcase housing 110 from top to bottom and containing the longitudinal centerline L, but may instead have some fore, aft, upward, or downward components. Generally, however, the first and second forces F1, F2 are directed cross-wise (lateral) enough to the gearcase housing 110, and generally opposite enough to one another, so as to produce a torque about the driveshaft 24. As noted herein above, the present inventor configured the fore and aft skegs 116, 120 to produce a torque on the lower unit 38 as the lower unit 38 moves through water that is opposite a rotational direction of the driveshaft 24. Note that the present example shows the driveshaft 24 spinning in a counter-clockwise direction when viewed from below (see arrow S, FIG. 7). Thus, the directions of the forces F1 and F2 are intended to create a moment in the opposite direction. However, if the driveshaft 24 were designed to spin in the opposite direction, the directions of the forces F1 and F2 would be opposite than shown.

Figure 10:
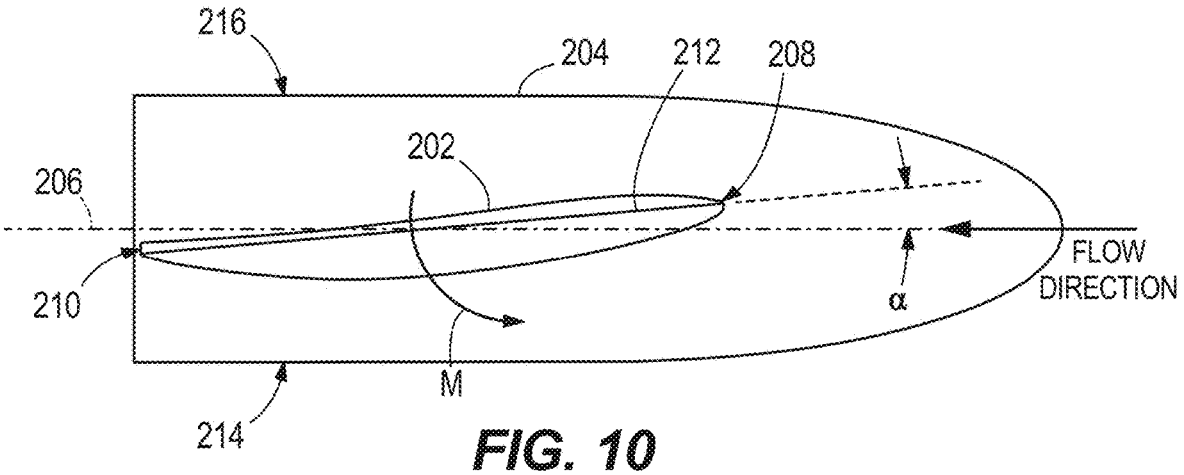
FIG. 10 illustrates a schematic of a skeg on a gearcase housing, the skeg having a negative angle of attack.
Figure 11:
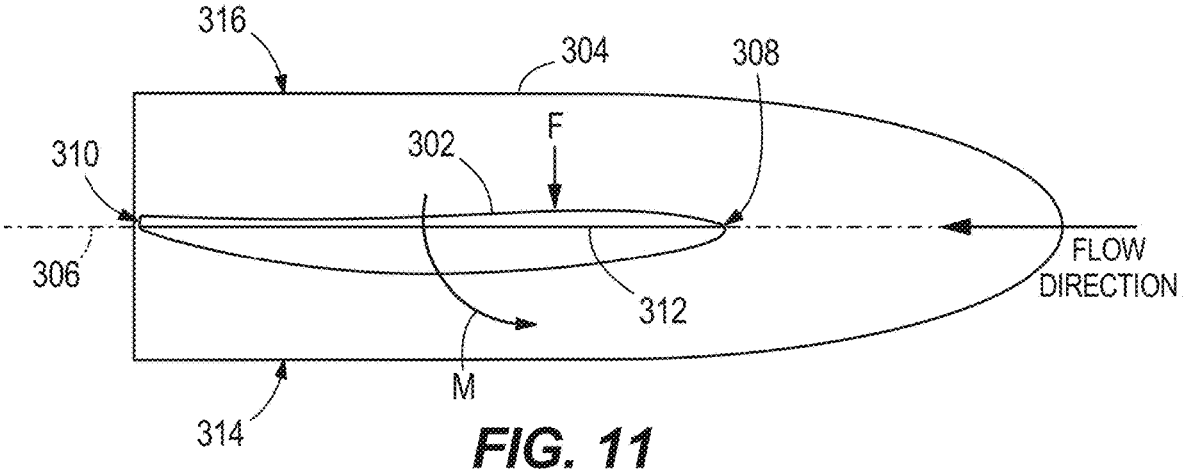
FIG. 11 illustrates a schematic of a skeg on a gearcase housing, the skeg having zero angle of attack.
Figure 12:
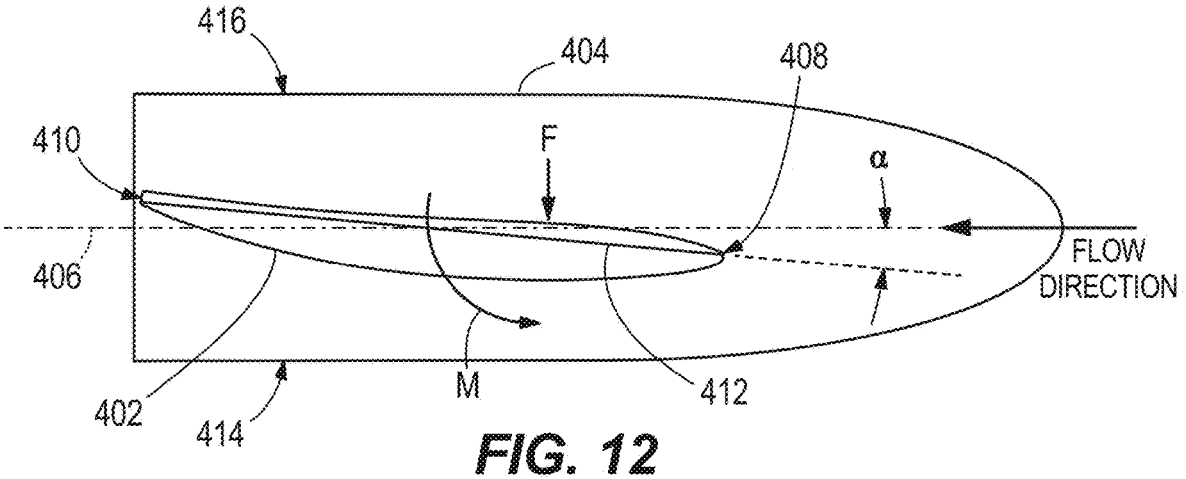
FIG. 12 illustrates a schematic of a skeg on a gearcase housing, the skeg having a positive angle of attack.

The forces F1 and F2 are induced by flow of water past the fore and aft skegs 116, 120 due to their shape and/or position on the gearcase housing 110, as the lower unit 38 moves through water. More specifically, the fore and/or aft skeg 116, 120 can have camber and/or an angle of attack that causes the skeg 116 and/or 120 to exert a pushing force on the gearcase housing 110. FIGS. 10-12 are now referred to in order to illustrate how camber and angle of attack can cause a skeg to create such a pushing force.

FIG. 10 shows a bottom view of a skeg 202 on a gearcase housing 204. A direction of water flow is shown by the arrow, and continues along dashed line 206, which in this example is coincident with the longitudinal centerline of the gearcase housing 204. The skeg 202 has a leading edge 208 and a trailing edge 210. An angle of attack a of the skeg 202 is defined by the angle between a chord line 212 connecting the leading edge 208 and trailing edge 210 with respect to the flow direction of the water 206. Due to its negative angle of attack a, the skeg 202 deflects the oncoming flow of water 206 to the port side 214 of the gearcase housing 204, causing an equal and opposite force to act on the skeg 202. However, note that the skeg 202 is also cambered. The camber of the skeg 202 also deflects the oncoming flow of water 206, but toward the starboard side 216 of the gearcase housing 204, causing an equal and opposite force to act on the skeg 202. In this example, the forces due to the negative angle of attack and camber cancel one another out, and no resultant side force acts on the skeg 202. However, the camber does cause a moment M to act on the skeg 202. Note that the location and dimension of moment M are for illustrative purposes only and are not to-scale. Note also that if the skeg 202 were cambered in the opposite direction of that shown, the moment would have an opposite direction, and a side force would also be created toward the starboard side 216 of the gearcase housing 204, assuming the angle of attack remained the same (although it would be considered positive due to the opposite camber).

FIG. 11 shows a bottom view of a skeg 302 on a gearcase housing 304. The direction of the flow of water is again shown by an arrow and dashed line 306, and again coincides with the longitudinal centerline of the gearcase housing 304. The angle of attack in FIG. 11 is zero degrees, as the chord line 312 connecting the leading and trailing edges 308, 310 of the skeg 302 is aligned with the water's flow direction 306. Here, a moment M is again created due to the skeg's camber. Additionally, the camber of the skeg 202 causes water to be deflected to the starboard side 316 of the gearcase housing 304, and an equal and opposite resultant side force F acts on the skeg 302 toward the port side 314. This force F will tend to rotate the gearcase housing 304 about a stationary axis of rotation, such as the steering axis 44 in the example of FIGS. 1-9. Note that the force F is shown for illustrative purposes only, and its location and dimension are not to-scale. Note also that if the skeg 302 were not cambered (i.e., symmetric), and oriented at an angle of attack of zero degrees, no side force or moment would be created. If the camber of the skeg were opposite that shown, and the angle of attack remained zero, the side force would instead be directed toward the starboard side 316 of the gearcase housing 304.

FIG. 12 shows a bottom view of a skeg 402 on a gearcase housing 404. The direction of the flow of water is again shown by an arrow and dashed line 406, and again coincides with the longitudinal centerline of the gearcase housing 404. The angle of attack a here is a positive angle of attack, defined between the chord line 412 connecting the leading and trailing edges 408, 410 of the skeg 402 and the water's flow direction 406. In this example, the angle of attack a causes the flow of water 406 to be diverted to the starboard side 416 of the gearcase housing 404, and an equal and opposite force therefore acts on the skeg 402. The camber, which is the same as in the examples of FIGS. 10 and 11, also causes water to be diverted to the starboard side 416 of the gearcase housing 404, and an equal and opposite resultant force thus acts on the skeg 402. The resultant force F on the skeg 402 is the sum of the reactionary forces due to the angle of attack and camber, and acts toward the port side 414 of the gearcase housing 404. This additive force F will tend to rotate the gearcase housing 404 about an axis of rotation, such as the steering axis 44. A moment M is also created in the example of FIG. 12, as in the previous examples. Note that the moment M in each of the examples of FIGS. 10-12 is more or less constant for a large range of angles of attack and increases slightly at very high angles of attack not at issue for a marine propulsion device. Note that, all else being equal except the angle of attack, the force will be higher in the example shown in FIG. 12 than that shown in FIG. 11, but the forces are not shown to scale. Also note that if the skeg 402 were cambered in the opposite direction, the force on the skeg 402 due to camber would be in the opposite direction and thus subtracted from the force due to the angle of attack.

Thus, it can be seen that both the angle of attack a and the camber of a skeg have an effect on forces created on the gearcase housing. Referring back to the example of FIGS. 5-9, it can be seen how side forces acting on the skegs 116, 120 can create a moment about the rotational axis of the gearcase housing 110, which here is the steering axis 44, which is coaxial with the driveshaft 24. As will be described herein below, either or both of the angle of attack and the camber of each skeg 116, 120 can be designed to create side forces F1 and F2 on the skegs 116, 120, respectively, (and thus on the gearcase housing 110) that tend to rotate the gearcase housing 110 in a direction opposite the direction of rotation S of the driveshaft 24.

In one example, both the fore and aft skegs 116, 120 are cambered to produce the first and second forces F1, F2, respectively. Additionally, both the fore and aft skegs 116, 120 have angles of attack configured to produce the first and second forces F1, F2, respectively. In fact, the camber and angles of attack combine to produce the first and second forces F1, F2, according to the principles noted herein above with respect to FIGS. 10-12. Referring to FIGS. 7 and 8, it can be seen that the fore skeg 116 is cambered toward the port side 122 of the gearcase housing 110 and has a positive angle of attack. Thus, the force F1 acting on the fore skeg 116 due to the flow of water past the gearcase housing 110 acts toward the port side 122 of the gearcase housing 110 (compare the illustrative example of FIG. 12). In contrast, referring to FIGS. 7 and 9, it can be seen that the aft skeg 120 is cambered toward the starboard side 124 of the gearcase housing 110 and has a slight negative angle of attack. Thus, the force F2 on the aft skeg 120 acts toward the starboard side 124 of the gearcase housing 110. (This is like the example of FIG. 10, but with opposite camber.) In the present example, the angle of attack of the aft skeg 120 is configured to account for a flow of water induced by the fore skeg 116. Because the fore skeg 116 diverts the flow of water toward the starboard side 124 of the gearcase housing 110, water is already flowing to the right when it reaches the aft skeg 120. Thus, the water already creates some side force to the right on the aft skeg 120, so the angle of attack of the aft skeg 120 can have a lesser magnitude than if there were no fore skeg 116, and still produce the desired side force F2.

The magnitude and location of the side forces F1, F2 are determinable based on the magnitude of the moment needed to oppose the torque from the driveshaft 24. It can be seen that the forces F1 and F2 act at distances from the steering axis 44 (which is coaxial with the driveshaft 24, as noted herein above). Those having ordinary skill in the art will understand that the force F1 multiplied by its distance from the steering axis 44, added to the force F2 multiplied by its distance from the steering axis 44, combine to produce a resultant moment $M_R$ about the steering axis 44, opposite the direction of rotation S of the driveshaft 24. (Those of ordinary skill in the art will also understand that the forces F1 and F2 do not act at single points on the skegs 116, 120, but rather across the entire surface area of the skeg. However, the forces F1, F2 are shown as acting at points, i.e. "centers of pressure," for purposes of simplifying the example.) The moment $M_R$ can be equal in magnitude to the torque from the driveshaft 24, or can be less than the torque from the driveshaft 24. Even in the latter instance, having some induced moment on the gearcase housing 110 that opposes the torque from the driveshaft 24 can reduce the load on the steering system that maintains the lower unit 38 in a desired steered position. In other examples, the moment $M_R$ is greater than the torque induced by the driveshaft 24.

In other examples, the skegs 116, 120 are only cambered so as to produce the side forces that tend to create torque on the gearcase housing 110 about the steering axis 44, but have zero angle of attack. In other examples, the skegs 116, 120 only have angles of attack configured to produce the side forces on the gearcase housing 110, but no camber. In still other examples, one or the other of the skegs 116 or 120 is cambered and has zero angle of attack, and the other of the skegs 116 or 120 has a positive or negative angle of attack and no camber.

In the present example, the fore skeg 116 is smaller than the aft skeg 120. This difference in skeg size can shift the net center of pressure of the gearcase housing 110 to a desired location. The presence of the smaller fore skeg 116 in this example shifts the net center of pressure forward from where it would otherwise be were there only an aft skeg 120. The net center of pressure on the gearcase housing 110 is therefore located closer to the steering axis 44 than it would be with only the aft skeg 120, resulting in less steering moment added during steering maneuvers, when the side force generated during a turn acts at the net center of pressure. Note that if the fore skeg 116 were larger than the aft skeg 120, this might shift the net center of pressure to be in front of the driveshaft 24, thus simply increasing steering moment in the opposite direction during steering maneuvers.

In order to develop skegs having the desired relative position, size, camber, and angle of attack, the gearcase housing 110 can be modeled using a 3D modeling program, and then tested using a computational fluid dynamics program to simulate the flow fields generated. The size, relative size, camber, angle of attack, longitudinal spacing, and location of the skegs 116, 120 can be modified until a desired result is achieved. Those having ordinary skill in the art will understand that the forces F1 and F2 on the fore and aft skegs 116, 120, respectively, will depend at least in part on the flow speed of water past the skegs 116, 120. An estimated predefined cruising speed for the marine propulsion device 20, or any other predefined speed, can be used as the flow speed of water for purposes of modeling the forces F1 and F2.

Thus, a marine propulsion device 20 with decreased torque bias about the steering axis 44 is disclosed. The marine propulsion device 20 comprises an engine 22, a driveshaft 24 powered by the engine 22, a propulsor shaft (such as propeller shafts 40) coupled in torque-transmitting relationship with the driveshaft 24 (either directly or by way of an extension member), and a propulsor (such as propellers 43) coupled to the propulsor shaft (e.g., propeller shafts 40) and rotatable to produce a thrust. The marine propulsion device 20 shown herein is an outboard motor, but the present invention is equally applicable to a stern drive or a pod drive. In still other examples, the marine propulsion device is a "tractor" drive, in which the propulsor (propeller) is located fore of the gearcase housing. In other examples, the propulsor is an impeller, such as used for a jet drive. A housing (such as the gearcase housing 110) supports the propulsor shaft therein, the housing having fore and aft skegs 116, 120 projecting from a bottom surface 118 thereof. In other examples, the housing may not hold any gears, and thus may not be considered a "gearcase" housing.

In the present example, the driveshaft 24 is oriented perpendicular to the propulsor shaft (e.g., propeller shafts 40), the fore skeg 116 is located forward of the driveshaft 24, and the aft skeg 120 is located behind the driveshaft 24. In other examples, the driveshaft 24 may be oriented non-parallel with respect to the propulsor shaft, such as if the shafts are oriented at 80 degrees with respect to one another. The fore skeg 116 is configured to produce a first laterally directed force F1 on the housing as the fore skeg 116 moves through water, and the aft skeg 120 is configured to produce a second laterally directed force F2 on the housing as the aft skeg 120 moves through water, the first and second forces F1, F2 being opposite one another. Because the fore and aft skegs 116, 120 are on opposite sides of the driveshaft 24, both the fore skeg 116 and the aft skeg 120 produce oppositely directed forces on the housing, imposing a torque tending to oppose the torque from the driveshaft 24. The fore and aft skegs 116, 120 are also spaced from one another in a longitudinal direction L of the housing, which means that the side forces F1, F2 can be less than if the skegs 116, 120 were closer together, but still have as great an effect given the relatively longer moment arms at which the lesser forces act.

In the present example, the housing (e.g., gearcase housing 110) is steerable independently of the engine 22 to affect a direction of the thrust produced by the propulsor (e.g., propellers 43). The fore and aft skegs 116, 120 are configured to produce a torque on the housing as the fore and aft skegs 116, 120 move through water, the torque being opposite a rotational direction of the driveshaft 24. The same concept could be used on a lower unit that is not steerable with respect to the engine 22, however, such as on a single-propeller marine drive. The propeller on a single-propeller marine drive creates a net side force, especially when the propeller is lifted on faster boats. The same concept of a dual-skeg gearcase housing could be implemented on such a single-propeller drive in order to minimize the net steering torque on the traditional steering system during straight-ahead operation. Although in the present example the lower unit 38 is steerable to change a direction of thrust produced by the marine propulsion device 20, the single-propeller lower unit need not be steerable.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A lower unit for a marine propulsion device, the lower unit comprising:

a gearcase housing defined in a longitudinal direction between a fore end and an aft end;

a propulsor shaft extending through the gearcase housing in the longitudinal direction;

a driveshaft extending non-parallel to the propulsor shaft, the driveshaft being coupled in torque-transmitting relationship with the propulsor shaft;

a fore skeg projecting from a bottom surface of the gearcase housing proximate the fore end thereof; and an aft skeg projecting from the bottom surface of the gearcase housing proximate the aft end thereof.

2. The lower unit of claim 1, wherein the fore and aft skegs are spaced from one another in the longitudinal direction.

3. The lower unit of claim 2, wherein the fore skeg is located forward of the driveshaft, and the aft skeg is located behind the driveshaft.

4. The lower unit of claim 1, wherein the fore skeg is configured to produce a first laterally directed force on the lower unit as the lower unit moves through water, and the aft skeg is configured to produce a second laterally directed force on the lower unit as the lower unit moves through water, the first and second forces being opposite one another.

5. The lower unit of claim 4, wherein the fore and aft skegs are cambered to produce the first and second forces, respectively.

6. The lower unit of claim 4, wherein the fore and aft skegs have angles of attack configured to produce the first and second forces, respectively.

7. The lower unit of claim 6, wherein the angle of attack of the aft skeg has a lesser magnitude than if there were no fore skeg so as to account for a flow of water induced by the fore skeg, such that the second force is the same as it would otherwise be were there no fore skeg and the angle of attack of the aft skeg were of a greater magnitude.

8. The lower unit of claim 1, wherein the fore and aft skegs are configured to produce a torque on the lower unit as the lower unit moves through water that is opposite a rotational direction of the driveshaft.

9. The lower unit of claim 1, wherein the fore skeg is smaller than the aft skeg.

10. The lower unit of claim 1, wherein the lower unit is steerable to change a direction of thrust produced by the marine propulsion device.

11. A marine propulsion device comprising:

a powered driveshaft;

a propulsor shaft coupled in torque-transmitting relationship with the driveshaft;

a propulsor coupled to the propulsor shaft and rotatable to produce a thrust; and a housing supporting the propulsor shaft therein, the housing having fore and aft skegs projecting from a bottom surface thereof.

12. The marine propulsion device of claim 11, wherein the fore and aft skegs are spaced from one another in a longitudinal direction of the housing.

13. The marine propulsion device of claim 12, wherein the driveshaft is oriented non-parallel to the propulsor shaft, and wherein the fore skeg is located forward of the driveshaft and the aft skeg is located behind the driveshaft.

14. The marine propulsion device of claim 11, wherein the fore skeg is configured to produce a first laterally directed force on the housing as the fore skeg moves through water, and the aft skeg is configured to produce a second laterally directed force on the housing as aft skeg moves through water, the first and second forces being opposite one another.

15. The marine propulsion device of claim 14, wherein the fore and aft skegs are cambered to produce the first and second forces, respectively.

16. The marine propulsion device of claim 14, wherein the fore and aft skegs have angles of attack configured to produce the first and second forces, respectively.

17. The marine propulsion device of claim 16, wherein the angle of attack of the aft skeg has a lesser magnitude than if there were no fore skeg so as to account for a flow of water induced by the fore skeg, such that the second force is the same as it would otherwise be were there no fore skeg and the angle of attack of the aft skeg were of a greater magnitude.

18. The marine propulsion device of claim 11, wherein the fore and aft skegs are configured to produce a torque on the housing as the fore and aft skegs move through water, the torque being opposite a rotational direction of the driveshaft.

19. The marine propulsion device of claim 11, wherein the fore skeg is smaller than the aft skeg.

20. The marine propulsion device of claim 11, wherein the housing is steerable independently of an engine powering the driveshaft to affect a direction of the thrust produced by the propulsor.

* * * * *